US011959256B2

(12) United States Patent
Yamashita

(10) Patent No.: US 11,959,256 B2
(45) Date of Patent: Apr. 16, 2024

(54) WORK MACHINE TARGET POSITION ESTIMATION DEVICE

(71) Applicant: KOBELCO CONSTRUCTION MACHINERY CO., LTD., Hiroshima (JP)

(72) Inventor: Koji Yamashita, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 450 days.

(21) Appl. No.: 17/428,459

(22) PCT Filed: Dec. 24, 2019

(86) PCT No.: PCT/JP2019/050518
§ 371 (c)(1),
(2) Date: Aug. 4, 2021

(87) PCT Pub. No.: WO2020/170599
PCT Pub. Date: Aug. 27, 2020

(65) Prior Publication Data

US 2022/0106774 A1 Apr. 7, 2022

(30) Foreign Application Priority Data

Feb. 19, 2019 (JP) ..... 2019-027435

(51) Int. Cl.
*E02F 3/43* (2006.01)
*E02F 9/26* (2006.01)

(52) U.S. Cl.
CPC ..... *E02F 9/265* (2013.01); *E02F 3/435* (2013.01)

(58) Field of Classification Search
CPC . E02F 9/265; E02F 3/435; E02F 9/264; E02F 9/205
See application file for complete search history.

(56) References Cited

U.S. PATENT DOCUMENTS

2016/0004305 A1* 1/2016 Pagliani ..... G06T 19/006 345/633
2016/0193920 A1* 7/2016 Tsubone ..... B60K 35/00 701/36

(Continued)

FOREIGN PATENT DOCUMENTS

JP 2018-185763 A 11/2018
WO WO 2017/145787 A1 8/2017

OTHER PUBLICATIONS

International Search Report dated Feb. 4, 2020 in PCT/JP2019/050518 filed on Dec. 24, 2019, 2 pages.

*Primary Examiner* — Anne Marie Antonucci
*Assistant Examiner* — Jared C Bean
(74) *Attorney, Agent, or Firm* — Oblon, McClelland, Maier & Neustadt, L.L.P.

(57) ABSTRACT

An operative target position of a leading end device supposed by an operator of a working machine is estimated with high accuracy. The controller calculates a prospective locus region on the basis of respective detection results of a posture detecting part and a manipulation detecting part. The prospective locus region is a region based on a prospective locus along which a leading end device is prospected to shift. The controller calculates a gaze point region on the basis of a detection result of a sight detecting part. The gaze point region is a region based on a gaze point of an operator. The controller sets a target position in a region where the prospective locus region and the gaze point region overlap each other.

11 Claims, 5 Drawing Sheets

(56) References Cited

U.S. PATENT DOCUMENTS

2018/0164895 A1* 6/2018 Okamoto ..... G08C 17/02
2018/0217671 A1* 8/2018 Okamoto ..... G06F 3/0304

* cited by examiner

WORK MACHINE TARGET POSITION ESTIMATION DEVICE

TECHNICAL FIELD

The present invention relates to a working machine target position estimating apparatus for estimating an operative target position of an operator of a working machine.

BACKGROUND ART

Patent Literature 1 discloses a technology for estimating a region where a driver is gazing.

CITATION LIST

Patent Literature

Patent Literature 1: Japanese Unexamined Patent Publication No. 2018-185763

The technology disclosed in the Literature estimates a region (target position) where the driver is gazing on the basis of a direction of sight of the driver. However, for example, compared with a driver of an automobile which runs over a street, an operator of a working machine is likely to look at various positions as a target. Therefore, estimation of a target position only on the basis of the direction of a sight of an operator is likely to have insufficient accuracy.

SUMMARY OF INVENTION

An object of the present invention is to provide a working machine target position estimating apparatus which can estimate an operative target position of an operator of the working machine with high accuracy.

The present invention provides a working machine target position estimating apparatus for estimating a target position supposed by an operator in a working machine including a machine main body having a cab which allows an operator to seat therein, an attachment mounted on the machine main body, and a leading end device provided in a leading end portion of the attachment. The working machine target position estimating apparatus includes: a posture detecting part for detecting posture information being information related to a posture of the working machine; a manipulation detecting part for detecting manipulation information being information on the basis of which the operator manipulates the working machine; a sight detecting part for detecting sight information being information related to sight of the operator, a distance information detecting part for detecting distance information on a region in front of the working machine; and a controller for estimating a target position of the leading end device supposed by the operator when the operator manipulates the working machine to move the leading end device. The controller includes: a locus region setting section for setting, on the basis of the posture information detected by the posture detecting part and the manipulation information detected by the manipulation detecting part, a prospective locus region being a region which includes a prospective locus along which the leading end device is prospected to move and which is associated with the distance information; a gaze region setting section for setting, on the basis of the sight information detected by the sight detecting part, a gaze region being a region which includes a gaze point of the operator and is associated with the distance information; and a target position estimating section for estimating the target position of the leading end device on the basis of a region where the prospective locus region set by the locus region setting section and the gaze region set by the gaze region setting section overlap each other.

DESCRIPTION OF EMBODIMENTS

Figure 1:
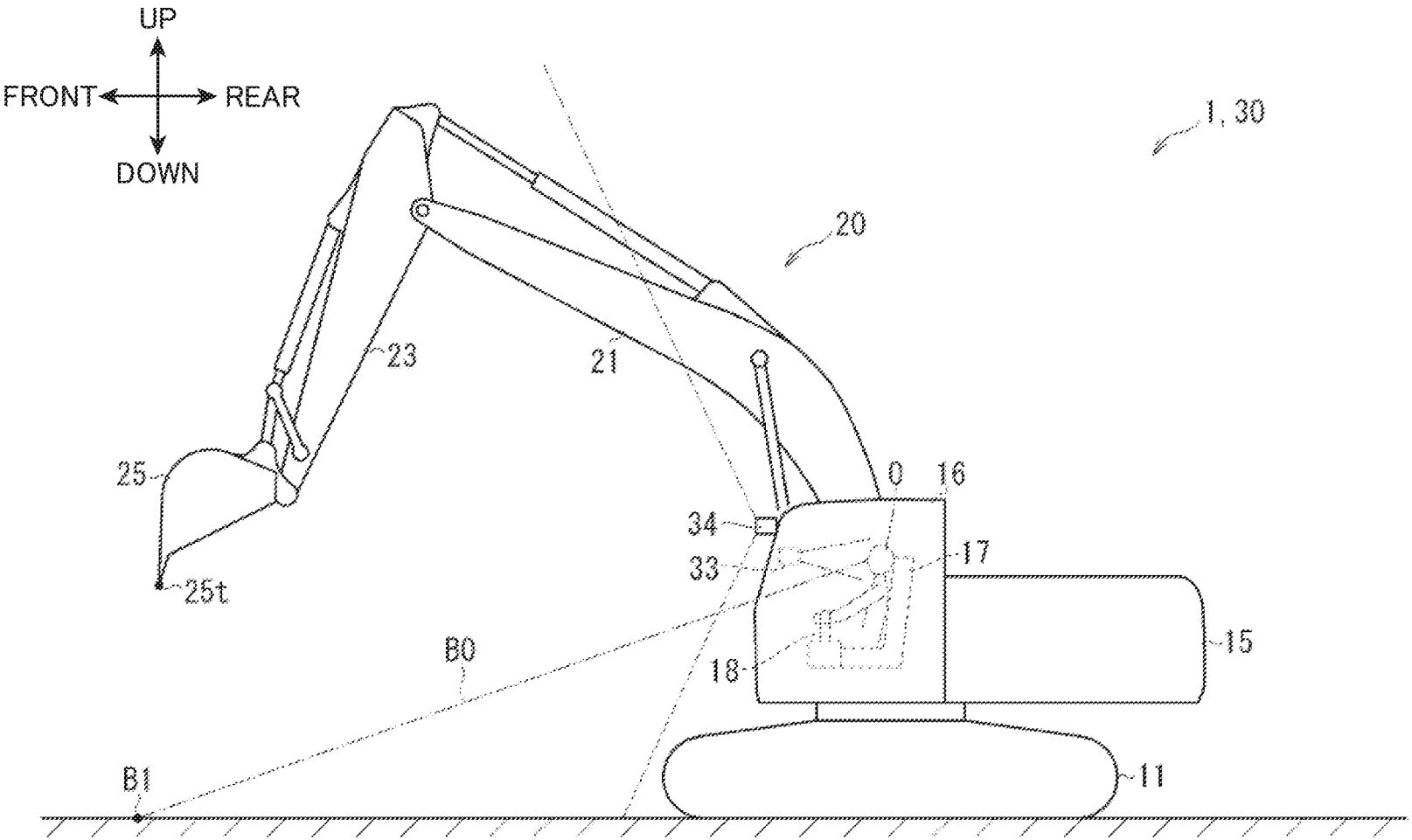
FIG. 1 is a side view of a working machine including a target position estimating apparatus according to an embodiment of the present invention.

A target position estimating apparatus 30 for use in the working machine 1 according to an embodiment of the present invention will be described with reference to FIGS. 1 to 5.

The working machine 1 is a machine which performs a work by use of a leading end device 25. The working machine 1 includes, for example, a construction machine for performing a construction work, and more specifically, includes a shovel and the like. The working machine 1 includes a lower travelling body 11 and an upper slewing body 15 (machine main body). The lower travelling body 11 is a part which causes the working machine 1 to travel. The upper slewing body 15 is slewable with respect to the lower travelling body 11, and is arranged above the lower travelling body 11. The upper slewing body 15 includes a cab 16 which allows an operator to seat therein.

The cab 16 is a driving room where an operator O, who manipulates the working machine 1, performs a manipulation. The cab 16 is provided with a seat 17 and a manipulating part 18. The seat 17 is a seat which the operator O sits on. The manipulating part 18 is a device for manipulating the working machine 1, and is manipulated by the operator O. The manipulations which are to be performed through the manipulating part 18 include a manipulation of causing the lower travelling body 11 to travel, a manipulation of causing the upper slewing body 15 to slew with respect to the lower travelling body 11, and a manipulation of causing an attachment 20 to operate. The manipulating part 18 may include, for example, a lever, or may include a pedal.

The attachment 20 is a device attached to the upper slewing body 15 to perform a work. The attachment 20 is, for example, driven by a hydraulic cylinder. The attachment 20 includes a boom 21, an arm 23, and a leading end device 25. The boom 21 is pivotally (raisably and lowerably) attached to the upper slewing body 15. The arm 23 is pivotally attached to the boom 21.

The leading end device 25 is a device which comes in contact with an operative target (for example, earth and sand). The leading end device 25 is provided on a leading end portion of the attachment 20. For example, the leading end device 25 is pivotally attached to the arm 23. The leading end device 25 may be, for example, a bucket for shoveling up the earth and sand, may be an (unillustrated) scissor-like device (such as a nibbler, a cutter), or may be an (unillustrated) breaker, or the like. As a position in connection with the leading end device 25, a specified position 25*t* is provided (detailed description will be made later).

Figure 2:
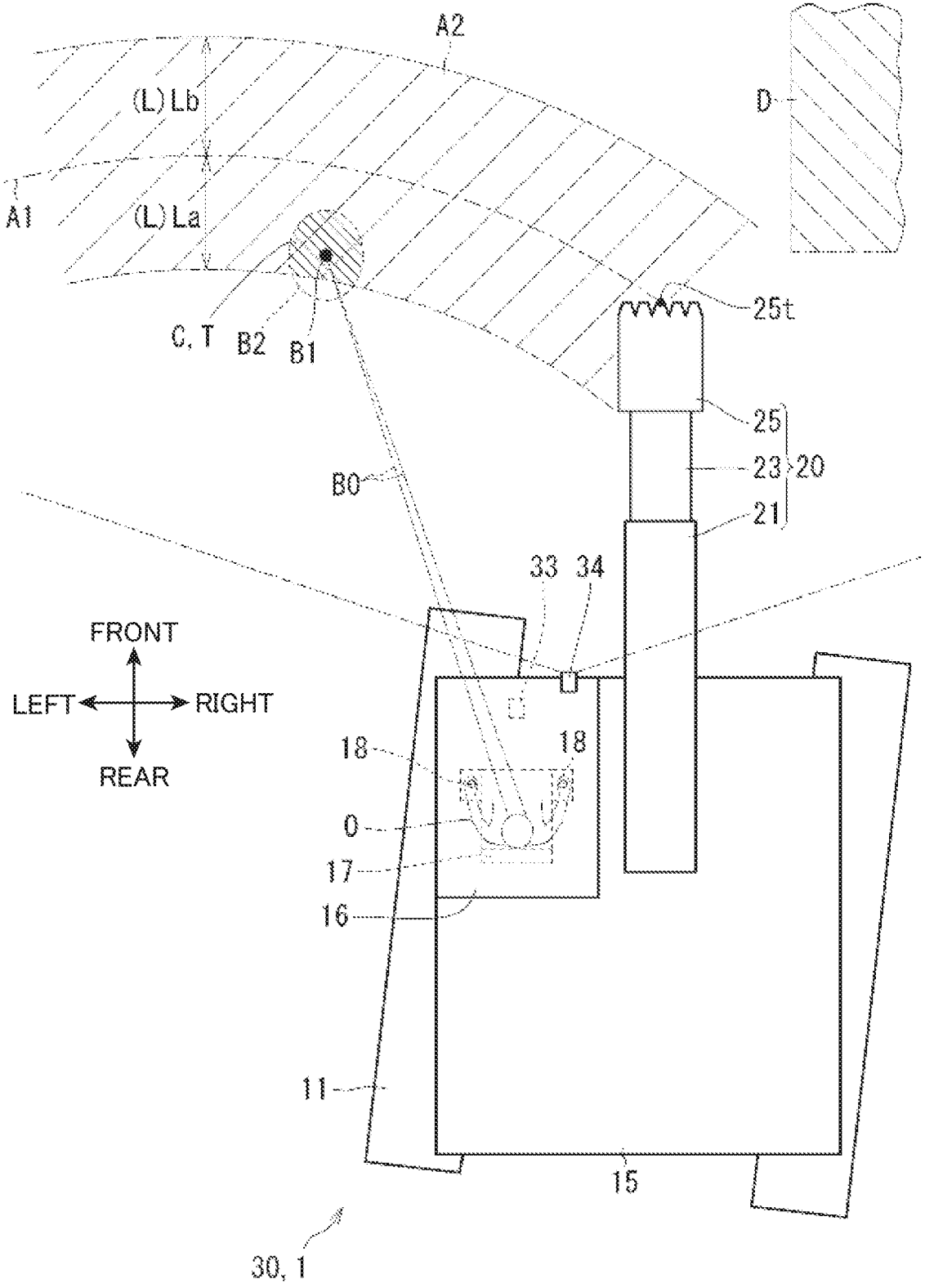
FIG. 2 is a plan view of the working machine according to the embodiment of the present invention.
Figure 3:
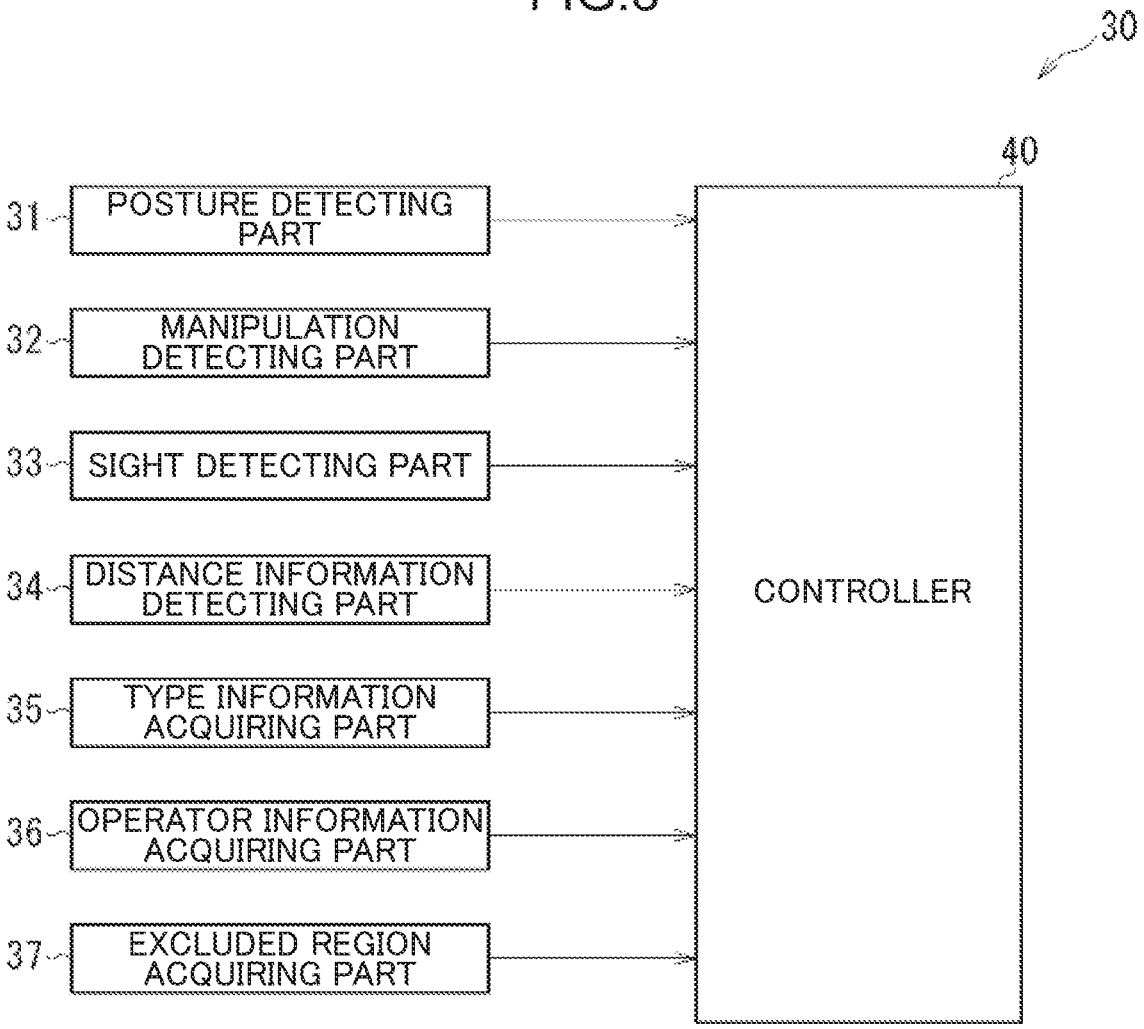
FIG. 3 is a block diagram of the target position estimating apparatus according to the embodiment of the present invention.
Figure 4:
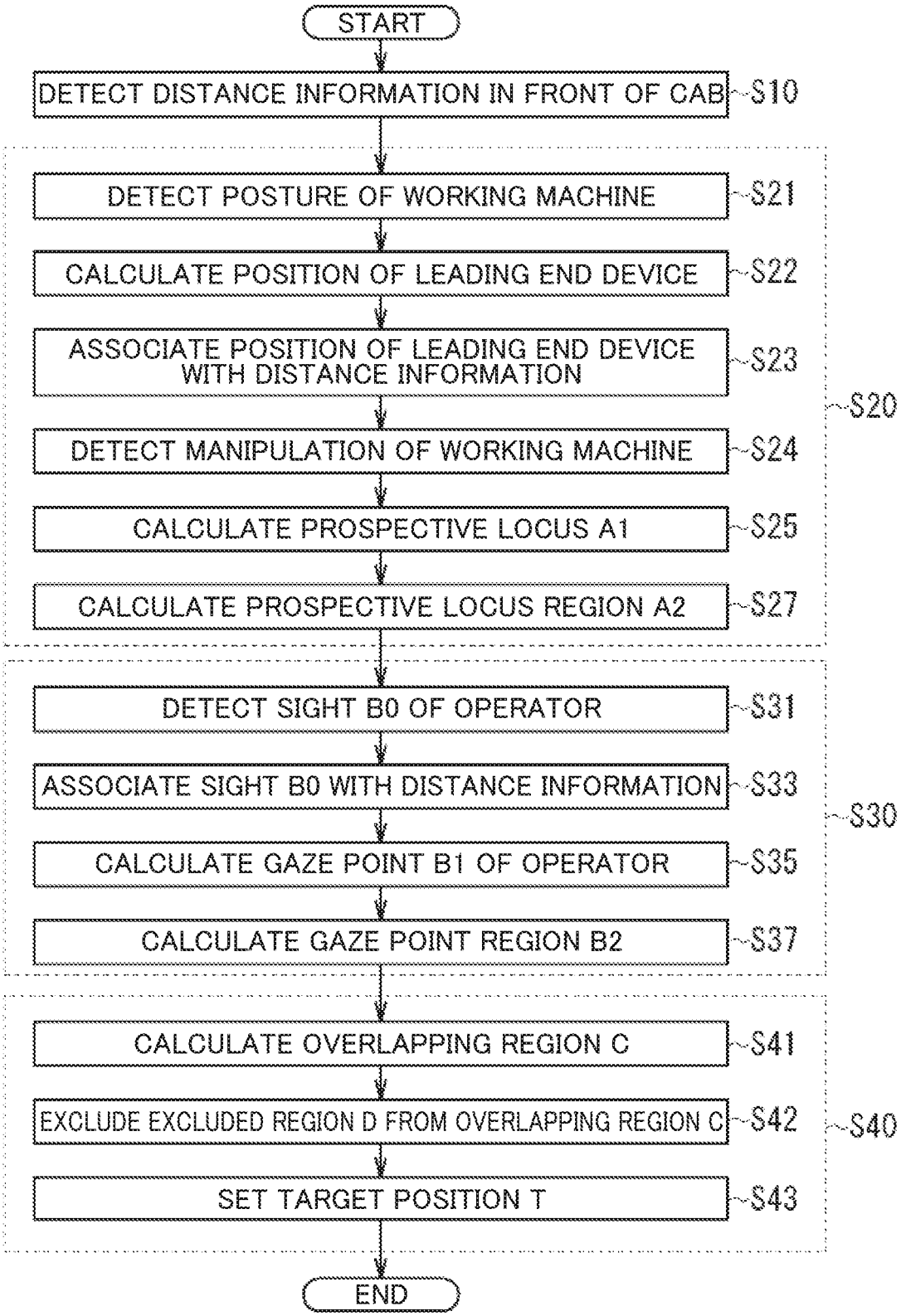
FIG. 4 is a flowchart showing an operation of the target position estimating apparatus according to the embodiment of the present invention.

The target position estimating apparatus 30 according to the present embodiment is an apparatus for estimating a position (operative target position) to which the operator O shown in FIG. 2 intends to perform an operation. The target position estimating apparatus 30 calculates the target position T on the basis of predetermined information. The target position estimating apparatus 30 estimates a target position of the leading end device 25 supposed by the operator O when the operator O manipulates the working machine 1 to move the leading end device 25 (more specifically, a specified position 25*t*). The target position estimating apparatus 30 is adapted for the working machine 1, and is arranged (attached, mounted) on the working machine 1. A part of the constituent elements of the target position estimating apparatus 30 may be arranged outside the working machine 1. As shown in FIG. 3, the target position estimating apparatus 30 includes a posture detecting part 31, a manipulation detecting part 32, a sight detecting part 33, a distance information detecting part 34, a type information acquiring part 35, an operator information acquiring part 36, an excluded region acquiring part 37, and a controller 40.

The posture detecting part 31 detects posture information being information related to a posture of the working machine 1 shown in FIG. 1. Specifically, the posture detecting part 31 (see FIG. 3) detects a slewing angle of the upper slewing body 15 with respect to the lower travelling body 11, and a posture of the attachment 20. With references to the posture of the attachment 20, there are, for example, a pivot angle of the boom 21 with respect to the upper slewing body 15, a pivot angle of the arm 23 with respect to the boom 21, and a pivot angle of the leading end device 25 with respect to the arm 23. The posture detecting part 31 may include a turning angle sensor for detecting a pivot angle. The posture detecting part 31 may include a camera, and detect a posture of at least a part (for example, the attachment 20) of the working machine 1 on the basis of image information acquired by the camera. The usage of"the camera" may be shared with the distance information detecting part 34. The posture detecting part 31 may detect a moving speed of the leading end device 25 by detecting postures of the attachment 20 at a predetermined time interval.

The manipulation detecting part 32 (see FIG. 3) detects manipulation information being information related to the manipulation of the working machine 1 by the operator O. The manipulation detecting part 32 detects the manipulation of the manipulating part 18 by the operator O, and specifically, for example, detects an amount and a direction of a manipulation which the manipulating part 18 has received The sight detecting part 33 (see FIG. 2, FIG. 3) detects sight B0 (sight information being information related to the sight) of the operator O. The sight detecting part 33 includes a camera directed to the seat 17, and detects the sight B0 by taking a picture of the eyes of the operator O.

The distance information detecting part 34 (see FIG. 2, FIG. 3) detects distance information on a region in front of the working machine 1, and more specifically, detects distance information in front of the upper slewing body 15. The "in front of the working machine 1" is a side (direction) viewed from a slewing center of the upper slewing body 15 where the leading end device 25 is arranged. The distance information detecting part 34 detects distance information related to a region which is around the working machine 1 and includes a field of view of the operator O. The distance information detected by the distance information detecting part 34 is three-dimensional information including a direction (angle) and a distance of a surrounding object relative to a predetermined reference point such as the operator O, and is image (motion image) information containing depth information. The distance information detecting part 34 may include, for example, a TOF (Time of Flight) camera, or may include a compound-eye camera. The distance information detected by the distance information detecting part 34 is made to be convertible into predetermined three-dimensional coordinates.

The type information acquiring part 35 (see FIG. 3) acquires information (type information) related to a type of the leading end device 25. The type information acquiring part 35 may acquire, for example, the type information related to the leading end device 25 on the basis of information manually input by the operator O and the like through an unillustrated input part in the cab 16. The type information acquiring part 35 may acquire type information related to the leading end device 25 by automatically discriminating a type of the leading end device 25 on the basis of an image acquired by a camera (for example, the distance information detecting part 34) and the like.

The operator information acquiring part 36 (see FIG. 3) acquires information (operator O information) related to the operator O who is manipulating the working machine 1. The operator O information may contain information (inherence information, personal information) as to who is the operator O. The operator O information may contain information related to settings of at least one of a prospective locus region A2 (see FIG. 2) and a gaze point region B2 (see FIG. 2) which will be described later. The operator information acquiring part 36 (see FIG. 3) may acquire the operator O information on the basis of information manually input by the operator himself through the input part. The operator information acquiring part 36 may acquire the operator O information from a device (for example, a wireless tag) possessed by the operator O. The operator information acquiring part 36 may acquire the operator O information (as to who is) from an image of the operator O taken by a camera.

The excluded region acquiring part 37 (see FIG. 3) acquires information related to the excluded region D which is a region kept away from the target position T shown in FIG. 2 (detailed description will be made later).

As shown in FIG. 3, the controller 40 executes an input and output of a signal, a storage of information, and a computation (calculation, determination, and the like). The controller 40 estimates the target position T of the leading end device 25 by performing a computation on the estimation of the target position T (see FIG. 2). The controller 40 includes a locus region setting section, a gaze region setting section, a target position estimating section, and a determining section. The locus region setting section sets, on the basis of the posture information detected by the posture detecting part 31 and the manipulation information detected by the manipulation detecting part 32, a prospective locus region A2 being a region which includes a prospective locus A1 along which the leading end device 25 is prospected to move and which is associated with the distance information. The gaze region setting section sets, on the basis of the sight information detected by the sight detecting part 33, a gaze point region B2 (gaze region) being a region which includes a gaze point B1 of the operator and is associated with the distance information. The target position estimating section estimates the target position T of the leading end device 25 on the basis of a region where the prospective locus region A2 set by the locus region setting section and the gaze point region B2 set by the gaze region setting section overlap each other. The determining section determines whether or not the leading end device 25 reaches the target position T within a predetermined time after the target position estimating section estimates the target position T of the leading end device 25. In the above, "the region associated with the distance information" may be a region expressed by the three-dimensional coordinates based on the distance information.

(Operation)

The target position estimating apparatus 30 operates in the following manner. Hereinafter, mainly, the configuration of the controller 40 is described with reference to FIG. 3, and each step (S10 to S43) executed by the target position estimating apparatus 30 with reference to FIG. 4. The operation of the target position estimating apparatus 30 shown in FIG. 2 is summarized as follows. The controller 40 (locus region setting section) calculates a prospective locus region A2 of the leading end device 25 on the basis of a posture of the attachment 20 and a manipulation received by the manipulating part 18 (Step S20). Next, the controller 40 (gaze region setting section) calculates a gaze point region B2 on the basis of a sight B0 of the operator O (Step S30). Further, the controller 40 (target position estimating section) defines as a target position T a range which excludes the excluded region D from an overlapping region C where the prospective locus region A2 and the gaze point region B2 overlap each other. The details on the operation of the target position estimating apparatus 30 are as follows.

Distance information detected by the distance information detecting part 34 (see FIG. 3) is input to the controller 40 (Step S10).

[Calculation of Prospective Locus Region A2 (Step S20)]

The controller 40 calculates the prospective locus region A2 on the basis of the posture information detected by the posture detecting part 31 (see FIG. 3) and the manipulation information detected by the manipulation detecting part 32 (see FIG. 3) (Step S20). The details on the calculation of the prospective locus region A2 are as follows.

A posture of the working machine 1 detected by the posture detecting part 31 (see FIG. 3) is input to the controller 40 (Step S21). The controller 40 (locus region setting section) calculates a position of the leading end device 25 on the basis of the posture of the working machine 1 (Step S22). At this stage, the controller 40 calculates, for example, a position of the leading end device 25 with respect to a predetermined reference position. The "reference position" may be, for example, a position in the distance information detecting part 34, or may be a specified position (for example, of the cab 16) in the upper slewing body 15. Information required for the calculation of the position of the leading end device 25 with respect to the reference position other than a posture of the working machine 1 is set in the controller 40 in advance (prior to the calculation of the position of the leading end device 25). Specifically, for example, information such as a position of the proximal end portion of the boom 21 with respect to the reference position, respective sizes, shapes, and the like of the boom 21, the arm 23, and the leading end device 25 is set in the controller 40 in advance (stored in a storage part of the controller 40).

The controller 40 associates information on the position of the leading end device 25 with the distance information (Step S23). Further specifically, the controller 40 associates (conforms, superimposes) information on an actual position of the leading end device 25 with respect to the reference position with a position of data (coordinates) of the distance information. Information required for the association is set in the controller 40 in advance similarly to the above. Specifically, for example, information such as a position and a detection direction of the distance information detecting part 34 with respect to the reference position is set in the controller 40 in advance.

The manipulation detected by the manipulation detecting part 32 (see FIG. 3) is input to the controller 40 (Step S24).

The controller 40 calculates a prospective locus A1 on the basis of detection results of the posture detecting part 31 (see FIG. 3) and the manipulation detecting part 32 (see FIG. 3), respectively (Step S25). The prospective locus A1 is a locus along which the leading end device 25 (further specifically, a specified position 25*t*) is prospected to shift (move). Further specifically, the controller 40 detects a prospective locus A1 along which the leading end device 25 is prospected to shift in a case where the manipulation detected by the manipulation detecting part 32 is supposed to continue from now (current moment) until after the elapse of a predetermined time. FIG. 2 shows a prospective locus A1 of a case where the upper slewing body 15 slews to the left with respect to the lower travelling body 11 while the arm 23 opens with respect to the boom 21 from a state where the arm 23 is folded with respect to the boom 21. In this case, the prospective locus A1 is arranged in a space over the ground.

The controller 40 (locus region setting section) may change the prospective locus A1 in accordance with a certain condition. For example, the controller 40 may change (set) the prospective locus A1 in accordance with the type information related to the leading end device 25 acquired by the type information acquiring part 35. The details are as follows. The position which the operator O is supposed to gaze at during the operation varies depending on the type of the leading end device 25. Specifically, for example, in a case where the leading end device 25 is a bucket, the operator O is supposed to gaze at a leading end (specified position 25*t*) of the bucket. Further, for example, in a case where the leading end device 25 is a scissor-like device, the operator O is supposed to gaze at a space between the opened scissors. A position in connection with the leading end device 25 which the operator O is supposed to gaze at during the operation is defined as a specified position 25*t*. Thereafter, the controller 40 calculates (sets) a locus along which the specified position 25*t* is prospected to shift as the prospective locus A1.

Further, the controller 40 calculates (estimates) the prospective locus region A2 (Step S27). The prospective locus region A2 is a region including the prospective locus A1, and is calculated on the basis of the prospective locus A1. The prospective locus region A2 is a region (range of the position of data) in the distance information. In other words, the prospective locus region A2 is associated with the distance information. The distance from the prospective locus A1 to an outer end (boundary) of the prospective locus region A2 is defined as a distance L. The distance L in a first direction is defined as a distance La, and the distance L in a second direction different from the first direction is defined as a distance Lb.

An extent of the prospective locus region A2 is described. The target position T which the controller 40 is aimed at estimating is required to be within a range of the overlapping region C of the prospective locus region A2 and the gaze point region B2. Accordingly, the prospective locus region A2 is a candidate region for the target position T. Therefore, the narrower the prospective locus region A2 (the shorter the distance L) is, the narrower the candidate region for the target position T becomes. Consequently, the more likely the accuracy of the target position T is improved. On the other hand, the narrower the prospective locus region A2 is, the less likely the gaze point region B2 (detailed description will be made later) falls within the prospective locus region A2. Consequently, the less likely the target position T is identified. Besides, the broader the prospective locus region A2 (the longer the distance L) is, the broader the candidate region for the target position T becomes. Consequently, the more likely the gaze point region B2 falls within the prospective locus region A2. On the other hand, the broader the prospective locus region A2 is, the inferior the accuracy of the target position T becomes (however, it depends on the extent of the gaze point region B2).

The range of the prospective locus region A2 in conformity with the prospective locus A1 (hereinafter, also simply referred to as "range of the prospective locus region A2") may be set in various ways. For example, the extent of the prospective locus region A2, a deviation (difference) of the range of the prospective locus region A2 in conformity with the prospective locus A1 may be set in various ways. [Example 1] The prospective locus region A2 may be a range within a determined distance L from the prospective locus A1 (the distance L may have a constant value). In this case, the range of the prospective locus region A2 in conformity with the prospective locus A1 does not include any deviation. [Example 1a] The distance L may be zero. The prospective locus region A2 may coincide with the prospective locus A1, or may be a linear region. [Example 1b] In the case where the distance L has a constant value, the distance L may have a positive number. The prospective locus region A2 may be a spatially expandable range.

[Example 2] The distance L is not required to be constant. [Example 2a] The distance L may be set (changed) in accordance with a direction in conformity with the prospective locus A1. Specifically, for example, a distance La in a first direction (for example, the distance La on the working machine 1 side with respect to the prospective locus A1) may differ from a distance Lb in a second direction (for example, the distance Lb on the side opposite to the working machine 1 with respect to the prospective locus A1). [Example 2b] The distance L may vary in accordance with a distance from a specified position on the working machine 1. For example, the more distant the specified position is from the cab 16, the greater the distance L may be set to be. For example, the more distant the specified position is from the current position of the leading end device 25, the greater the distance L may be set to be.

[Example 3] The range of the prospective locus region A2 may be changed (set) in accordance with a certain condition. [Example 3a] The range of the prospective locus region A2 may be set on the basis of information (for example, a value of the distance L) input by the operator O and the like.

[Example 3b] The controller 40 may change the range of the prospective locus region A2 in conformity with the prospective locus A1 in such a manner that the range varies in accordance with the moving speed of the leading end device 25. The moving speed of the leading end device 25 is calculated, for example, as a variation of the position of the leading end device 25 per unit time, which is to be calculated in Step 22. The difference between an actual operative target position of the operator O and the prospective locus A1 increases as the moving speed of the leading end device 25 increases, which thus increases the likelihood that the gaze point region B2 does not fall within the prospective locus region A2. Consequently, the likelihood that the target position T cannot be identified will increase. Accordingly, the controller 40 may set a broader prospective locus region A2 when the moving speed of the leading end device 25 is higher. This is merely an example (the same applies to the specific examples below). The controller 40 may set a narrower prospective locus region A2 when the moving speed of the leading end device 25 is higher.

[Example 3c] The controller 40 may change the range of the prospective locus region A2 in conformity with the prospective locus A1 in accordance with the posture (attachment posture information) of the attachment 20 detected by the posture detecting part 31. Further specifically, the prospective locus A1 may be calculated on the basis of the posture of the attachment 20 (Steps S21 to S25). Further, the range of the prospective locus region A2 in conformity with the prospective locus A1 may be changed in such a manner that the range varies in accordance with the posture of the attachment 20. For example, the difference between the actual operative target position of the operator O and the prospective locus A1 increases as the length (for example, the distance from the cab 16 to the leading end device 25) of the attachment 20 in a horizontal direction increases. Consequently, the likelihood that the target position T cannot be identified will increase. Accordingly, the controller 40 may set a broader prospective locus region A2 (a larger distance L) when the attachment 20 is longer in the horizontal direction.

[Example 3d] The controller 40 may change the range of the prospective locus region A2 in accordance with information related to a type of the leading end device 25 acquired by the type information acquiring part 35.

[Example 3e] The controller 40 may change the range of the prospective locus region A2 in conformity with the prospective locus A1 in accordance with the operator O information acquired by the operator information acquiring part 36. Specifically, for example, the magnitude of difference between an actual locus of the leading end device 25 and the prospective locus A1 varies depending on the proficiency of the operator O. For example, the more proficient the operator O is, the more capable the operator is of keeping the current manipulation condition of the manipulating part 18 to move the leading end device 25. Consequently, the difference between the actual locus of the leading end device 25 and the prospective locus A1 will be smaller. On the other hand, the less proficient the operator O is, the more numerous useless manipulations the operator O is likely to conduct, which thus increases the likelihood that the manipulation condition of the manipulating part 18 changes. Consequently, the difference between the actual locus of the leading end device 25 and the prospective locus A1 will be larger. Accordingly, the controller 40 may set a narrower prospective locus region A2 as the proficiency of the operator O increases, and set a broader prospective locus region A2 as the proficiency of the operator O lowers. Besides, the manipulation tendency (habit) may vary depending on each operator O. For example, the tendency of difference (magnitude, direction, or the like of difference) between the actual locus of the leading end device 25 and the prospective locus A1 may vary depending on each operator O. Besides, the tendency of difference between the gaze point region B2 and the prospective locus A1 may vary depending on each operator O. Accordingly, the controller 40 may change the prospective locus region A2 depending on each operator O.

[Example 3f] The controller 40 may change (adjust) the range of the prospective locus region A2 by learning. For example, the determining section of the controller 40 determines whether or not the leading end device 25 (further specifically, the specified position 25*t*) reaches a target position T within a first predetermined time after estimating the target position T (after Step 43 which will be described later). Thereafter, the controller 40 (locus region setting section) changes the range of the prospective locus region A2 in accordance with the determination result. Specifically, for example, when an operation by the working machine 1 starts, the controller 40 sets the prospective locus region A2 as broad as possible so that more likely the gaze point region B2 falls within the prospective locus region A2. Subsequently, in the operation an estimation of the target position T is performed. The case where the leading end device 25 actually moves to the target position T within a certain time (first predetermined time) after the estimation of the target position T means that the estimation of the target position T is correct. In this case, the controller 40 narrows the prospective locus region A2 in order to improve the accuracy of the target position T. For example, the controller 40 may narrow the prospective locus region A2 in the case where a correct estimation of the target position T occurs more than a predetermined number of times. On the other hand, the case where the leading end device 25 does not move to the target position T within the first predetermined time after the estimation of the target position T means that the estimation of the target position T is not correct. In this case, the controller 40 broadens the candidate region for the target position T by broadening the prospective locus region A2. This makes it more likely that the actual operative target position of the operator O falls within the target position T.

[Calculation of Gaze Point Region B2 (Step S30)]

The controller 40 calculates (estimates) a gaze point region B2 on the basis of a detection result of the sight detecting part 33 (see FIG. 3) (Step S30). The details on the calculation of the gaze point region B2 are as follows.

Information on (direction of) sight B0 of the operator O detected by the sight detecting part 33 is input from the sight detecting part 33 to the controller 40 (Step S31).

The controller 40 associates the information on the sight B0 with distance information (Step S33). Further specifically, the controller 40 associates (conforms, superimposes) an actual position (for example, a position and a direction of a point where the sight B0 passes) of the sight B0 with a position of data of the distance information. Information required for the association is set in the controller 40 in advance. Specifically, for example, information such as a position and a detection direction of the sight detecting part 33 with respect to the reference position is set in the controller 40 in advance.

The controller 40 calculates a gaze point B1 (eye point position) on the basis of a detection result of the sight detecting part 33 (Step S35). The gaze point B1 is a position (position of data) in the distance information in conformity with an actual position which the operator O gases at. In other words, the gaze point B1 is a part where the sight of the operator O intersects the ground. In the other embodiments, the gaze point B1 may be a part where an object (target) to be shattered by the leading end device 25, the sight of the operator O, and the ground intersect one another.

The controller 40 calculates a gaze point region B2 on the basis of a detection result of the sight detecting part 33 (Step S37). The gaze point region B2 is a region (range of position) of data in the distance information, and is a region based on the gaze point B1. Similarly to the prospective locus region A2, the gaze point region B2 is a candidate region for the target position T. The narrower the gaze point region B2 is, the narrower the candidate region for the target position T becomes. Consequently, the more likely the accuracy of the target position T is improved. On the other hand, the narrower the gaze point region B2 is, the less likely the gaze point region B2 falls within the prospective locus region A2. Consequently, the less likely the target position T is identified. Besides, the broader the gaze point region B2 is, the broader the candidate region for the target position T becomes. Consequently, the more likely the gaze point region B2 falls within the prospective locus region A2. On the other hand, the broader the gaze point region B2 is, the inferior the accuracy of the target position T becomes (however, it depends on the extent of the prospective locus region A2).

The range (for example, extent) of the gaze point region B2 (also simply referred to as "range of the gaze point region B2") in conformity with the gaze point B1 may be set in various ways. [Example 4] The gaze point region B2 may coincide with the gaze point B1. The gaze point region B2 may have a dot or linear shape. [Example 4a] In this case, a current (momentary) gaze point B1 may be defined as a gaze point region B2. [Example 4b] A locus of the gaze point B1 within a certain time may be defined as a gaze point region B2. Here, "a certain time" may be a fixed time, or may be set in various ways similarly to a second predetermined time that will be described below (the same applies to "a certain time" in [Example 5b] below). [Example 5] The gaze point region B2 may be an expandable region. [Example 5a] In this case, an expandable region including the current (momentary, single) gaze point B1 may be defined as the gaze point region B2. [Example 5b] Besides, an expandable region including a locus of the gaze point B1 within a certain time may be defined as a gaze point region B2.

Figure 5:
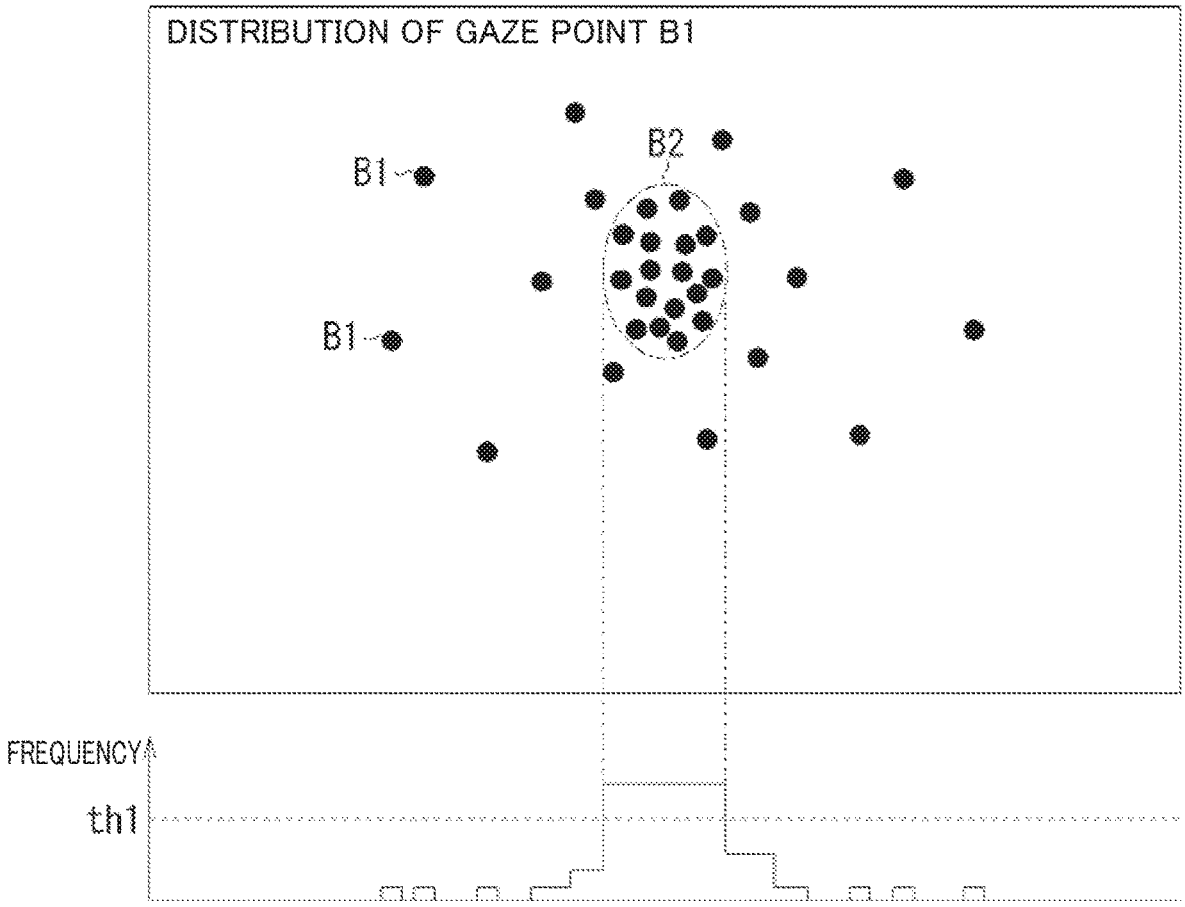
FIG. 5 is a diagram showing a distribution of gaze point of an operator that is referred to in the target position estimating apparatus according to the embodiment of the present invention.

[Example 6] While the gaze point B1 of an operator O always fluctuates, a region which the operator O is estimated to particularly gaze at may be defined as the gaze point region B2. Further specifically, the controller 40 may set the gaze point region B2 on the basis of a distribution of the gaze point B1 including a frequency within a certain time (second predetermined time) as shown in FIG. 5. In FIG. 5, only a part of the gaze points B1 among a plurality of gaze points B1 represented by dots are allotted with reference signs. [Example 6a] Specifically, the gaze region setting section can calculate a frequency distribution of the gaze point B1 by dividing the distance information into a plurality of regions, and counting the number of times the gaze point B1 falls within each region. The controller 40 (gaze region setting section) defines a region among a plurality of regions in the distance information where a frequency of the gaze point B1 is higher than a threshold value th1 (gaze point region setting threshold value) as the gaze point region B2. [Example 6a1] For example, the gaze region setting section may divide the distance information into a plurality of regions as a mesh, and calculate the frequency distribution of the gaze point B1 in each region. [Example 6a2] An example in FIG. 5 shows the frequency distribution of the gaze point B1 in a right-left direction in FIG. 5. [Example 6a3] A frequency distribution of the gaze point B1 in a vertical direction in FIG. 5 may be calculated.

[Example 7a] In [Example 6], the time (second predetermined time) for acquiring a distribution of the gaze point B1 may be a fixed time. [Example 7b] In [Example 6], the threshold value th1 for determining the gaze point region B2 may have a constant value.

[Example 8] The range (hereinafter, also simply referred to as "range of the gaze point region B2") of the gaze point region B2 in conformity with the gaze point B1 may be changed (set) in accordance with a certain condition. Specifically, at least one of the second predetermined time and the threshold value th1 may be changed in accordance with a certain condition. The longer the second predetermined time is set to be, the broader the gaze point region B2 becomes. The smaller the threshold value th1 is set to be, the broader the gaze point region B2 becomes. [Example 8a] A relationship between the gaze point B1 and the gaze point region B2 may be changed in accordance with information input by the operator O and the like.

[Example 8b] The controller 40 may change (set) the range of the gaze point region B2 in accordance with a moving speed of the leading end device 25 shown in FIG. 2. The moving speed of the leading end device 25 is calculated, for example, as a variation in the position of the leading end device 25 per unit time, which is to be calculated in Step 22. For example, it can be considered that the higher the moving speed of the leading end device 25 is, the shorter the actual time in which the operator O looks at the operative target position is. Accordingly, the controller 40 may set a shorter second predetermined time when the moving speed of the leading end device 25 is higher. This is merely an example (the same applies to the specific examples below). The controller 40 may set a longer second predetermined time when the speed of the leading end device 25 is higher.

[Example 8c] The controller 40 may change the range of the gaze point region B2 in accordance with a posture of the attachment 20 detected by the posture detecting part 31. [Example 8d] The controller 40 may change the range of the gaze point region B2 in accordance with the type information of the leading end device 25 acquired by the type information acquiring part 35.

[Example 8e] The controller 40 may change the gaze point region B2, i.e., set the range of the gaze point region B2 in conformity with the gaze point in accordance with the operator O information acquired by the operator information acquiring part 36. Specifically, for example, an actual time for gazing at the operative target position and the degree of fluctuation of the gaze point B1 vary depending on each operator O. For example, the fluctuation of the gaze point B1 is considered to be smaller when the operator O is more proficient. Accordingly, the controller 40 may set a narrower gaze point region B2 when the proficiency of the operator O is higher, and set a broader gaze point region B2 when the proficiency of the operator O is lower. Specifically, for example, in this case, the controller 40 may shorten the second predetermined time, or increase the threshold value th1.

[Example 8f] The controller 40 may change (adjust) the range of the gaze point region B2 by learning. For example, the determining section of the controller 40 can determine whether or not the leading end device 25 (further specifically, the specified position 25*t*) reaches a target position T within a third predetermined time after the target position estimating section estimates the target position T (after Step 43). Thereafter, the controller 40 changes the gaze point region B2 in accordance with the determination result. Specifically, for example, similarly to [Example 3f] above, when an operation by the working machine 1 starts, the controller 40 sets the gaze point region B2 as broad as possible so that more likely the gaze point region B2 falls within the prospective locus region A2. Subsequently, during the operation of the working machine 1, an estimation of the target position T is performed. The case where the leading end device 25 actually reaches the target position T within a certain time (third predetermined time) after the estimation of the target position T means that the estimation of the target position T is correct. In this case, the controller 40 may narrow the gaze point region B2 in order to improve the accuracy of the target position T. Besides, the controller 40 may narrow the gaze point region B2 in the case where a correct estimation of the target position T occurs more than a predetermined number of times. On the other hand, case where the leading end device 25 does not move to the target position T within the third predetermined time after the estimation of the target position T means that the estimation of the target position T is not correct. In this case, the controller 40 may broaden the candidate region for the target position T by setting a broader gaze point region B2. This makes it more likely that the actual operative target position of the operator O falls within the target position T.

Since an operator O generally has a single actual operative target position, generally has a single gaze point region B2. The example shown in FIG. 2 includes a single gaze point region B2. On the other hand, there is a case of including a plurality of regions (arranged at positions away from one another) which meet the requirement for a gaze point region B2. In this case, the plurality of regions meeting the requirement for a gaze point region B2 may be directly defined as gaze point regions B2. Besides, in this case, a single range which includes "the plurality of regions" and is broader than the current gaze point region B2 may be defined as a new gaze point region B2.

[Calculation of Target Position T (Step S40)]

The controller 40 calculates (estimates) the target position T on the basis of the prospective locus region A2 and the gaze point region B2 (Step S40). The details of the calculation are as follows.

The controller 40 calculates an overlapping region C which is within a range of the prospective locus region A2 and a range of the gaze point region B2 (Step S41). When there is no overlapping region C, the target position T will not be calculated. In this case, for example, it is desirable that, from a subsequent processing onward, at least one of the prospective locus region A2 and the gaze point region B2 is set to be broader than the current one (of the present processing).

Next, the excluded region D acquired by the excluded region acquiring part 37 (see FIG. 3) is input to the controller 40. The excluded region D is a region kept away from the target position T. Specifically, for example, in a case where the working machine 1 performs an operation of excavating earth and sand, a region where a transport vehicle of the earth and sand is present, a region where a building is present, and the like do not constitute an actual operative target position of the operator O. Accordingly, the relevant regions not constituting the actual operative target position is set as an excluded region D. Thereafter, the controller 40 excludes the excluded region D from the overlapping region C (Step S42). The excluded region D, for example, may be acquired on the basis of information input by the operator O and the like. The excluded region D may be automatically set on the basis of the distance information of the distance information detecting part 34, or may be automatically set on the basis of an image acquired by a detecting part (such as a camera) other than the distance information detecting part 34.

The controller 40 (target position estimating section) sets a region excluding the excluded region D from the overlapping region C as a target position T (Step S43). The target position T is updated, for example, each predetermined time. The target position T is variously applicable, and for example, may be applied to a manipulation assistance, a manipulation guidance, a manipulation training, a manipulation automation (for example, a manipulation by the sight B0), and the like.

(Example of Background)

Labor shortage in construction sites has become problematic, and especially, a decrease in the productivity in construction sites due to shortage of proficient operators has become problematic. More particularly, an inexpert operator conducts more useless manipulations and has more difficulty in performing a stable operation compared with a proficient operator, and constitutes a factor for a decrease in the productivity. Further specifically, an inexpert operator, even when identifying an operative target position, is likely to lack a skill enough to move the leading end device 25 and stop at the position rapidly and efficiently. Besides, the inertial forces and the characteristics of an upper slewing body 15 and an attachment 20 vary depending on the type (size, and as to whether it is a short rear slewing radius machine or not) of the working machine 1. Therefore, even an operator accustomed to the manipulation of a certain machine type needs time to understand the characteristics of a working machine 1 to thereby be able to manipulate the machine each time the type of the working machine 1 changes. Although a manipulation assistance, a manipulation guidance, a manipulation training, a manipulation automation, and the like are conceivable to solve the problems, these solutions require an identification of a specific target position T. These problems concerning Example of background are not necessarily required to be solved by the present embodiment.

Besides, a driver of an automobile generally has a travel target position over a predetermined street. On the other hand, in a working machine 1, an operator O may have various positions as an operative target position. For example, in the working machine 1, the operator O determines an operative target position to a working ground in a certain free area taking into consideration actual states, shape, and others of the ground. Therefore, it is difficult to estimate an operative target position only on the basis of information on the sight B0 of the operator O. On the other hand, in the present embodiment, the operative target position of the operator O on the working machine 1 can be estimated as follows.

Advantageous Effects

The advantageous effects provided by the target position estimating apparatus 30 shown in FIG. 2 are as follows. The controller 40 is described with reference to FIG. 3.

The target position estimating apparatus 30 is used in the working machine 1 including a leading end device 25 provided in the leading end portion of the attachment 20. As shown in FIG. 3, the target position estimating apparatus 30 includes a posture detecting part 31, a manipulation detecting part 32, a sight detecting part 33, a distance information detecting part 34, and a controller 40. The posture detecting part 31 detects a posture of the working machine 1 shown in FIG. 2. The manipulation detecting part 32 (see FIG. 3) detects a manipulation to the working machine 1. The sight detecting part 33 (see FIG. 3) detects a sight B0 of the operator O who manipulates the working machine 1. The distance information detecting part 34 (see FIG. 3) detects distance information on a region in front of the working machine 1. The controller 40 estimates a target position T of the operator O.

The controller 40 shown in FIG. 3 calculates a prospective locus region A2 shown in FIG. 2 on the basis of detection results of the posture detecting part 31 and the manipulation detecting part 32, respectively. The prospective locus region A2 is a region based on the prospective locus A1 along which the leading end device 25 is prospected to shift and which is contained in the distance information. The controller 40 calculates a gaze point region B2 on the basis of a detection result of the sight detecting part 33. The gaze point region B2 is a region based on the gaze point B1 of the operator O and is contained in the distance information. The target position T is required to be within the range of the prospective locus region A2 and within the range (overlapping region C) of the gaze point region B2.

In the configuration, the requirements for the target position T include being within the range of the gaze point region B2 based on the gaze point B1 of the operator O and within the range of the prospective locus region A2 of the leading end device 25. Therefore, compared with the case of estimating the target position T only on the basis of information related to the gaze point B1 of the operator O, the accuracy of the target position T with respect to the actual operative target position of the operator O can be improved. Accordingly, the operative target position of the operator O of the working machine 1 can be estimated with high accuracy.

Besides, the controller 40 changes the prospective locus A1 in accordance with information related to a type of the leading end device 25.

The position (specified position 25*t*) which the operator O considers as the operative target position varies depending on the type of the leading end device 25. Therefore, a proper prospective locus A1 varies depending on each type of the leading end device 25. Accordingly, the target position estimating apparatus 30 includes the configuration described above. The configuration makes it possible to calculate a proper prospective locus A1 based on the type of the leading end device 25. As a result, a proper region (position, range) based on the type of the leading end device 25 can be set as a prospective locus region A2.

Further, the controller 40 changes the range of the prospective locus region A2 in conformity with the prospective locus A1 in accordance with the moving speed of the leading end device 25.

The configuration makes it possible to set a proper region based on the moving speed of the leading end device 25 as a prospective locus region A2.

For example, in the case where the controller 40 narrows the prospective locus region A2 (shortens the distance L), the accuracy of the target position T with respect to the actual operative target position of the operator O can be further improved. Besides, in the case where the controller 40 broadens the prospective locus region A2 (elongates the distance L), more likely the actual operative target position of the operator O falls within the prospective locus region A2 (the candidate region for the target position T).

Besides, the controller 40 changes the range of the prospective locus region A2 in conformity with the prospective locus A1 in accordance with the posture of the attachment 20.

The configuration makes it possible to set a proper region based on the posture of the attachment 20 as a range of the prospective locus region A2 in conformity with the prospective locus A1. As a result, the same advantageous effects as the case of the moving speed can be obtained.

Further, the controller 40 changes the range of the prospective locus region A2 in conformity with the prospective locus A1 in accordance with information related to the operator O who is manipulating the working machine 1.

The configuration makes it possible to set a proper region based on information related to the operator O as a prospective locus region A2. As a result, the same advantageous effects as the case of the moving speed can be obtained.

Furthermore, the controller 40 changes the range of the prospective locus region A2 in conformity with the prospective locus A1 on the basis of whether or not the leading end device 25 moves to the target position T within a first predetermined time after estimating the target position T.

If the leading end device 25 reaches the target position T within the first predetermined time after the controller 40 (target position estimating section) estimates the target position T, the estimation of the target position T can be said to be correct. On the other hand, if the leading end device 25 does not reach the target position T within the first predetermined time after the controller 40 estimates the target position T, the estimation of the target position T can be said to be incorrect. Accordingly, since the target position estimating apparatus 30 includes the configuration, the target position estimating apparatus 30 can set a proper region as the prospective locus region A2 on the basis of whether or not the estimation of the target position T is correct. As a result, the same advantageous effects as the case of the moving speed can be obtained.

Besides, the controller 40 sets the gaze point region B2 on the basis of a distribution, including a frequency, of the gaze point B1 within a second predetermined time.

Since an operator O has fluctuating viewpoints, a gaze point B1 of the operator O will not necessarily coincide with an actual operative target position of the operator O. Accordingly, since the target position estimating apparatus 30 includes the configuration, the target position estimating apparatus 30 can set a region having a high probability of being an actual operative target position of the operator O as a gaze point region B2.

For example, if the controller 40 broadens the gaze point region B2, the accuracy of the target position T with respect to the actual operative target position of the operator O is further improved. Besides, if the controller 40 narrows the gaze point region B2, the actual operative target position of the operator O is more likely to fall within the gaze point region B2 (the candidate region for the target position T).

Besides, the controller 40 changes the range of the gaze point region B2 in conformity with the gaze point B1 in accordance with the moving speed of the leading end device 25.

The configuration makes it possible to set a proper range in conformity with the moving speed of the leading end device 25 as a range of the gaze point region B2. As a result, the same advantageous effects as the case of the distribution of the gaze point B1 can be obtained.

Besides, the controller 40 can change the range of the gaze point region B2 in conformity with the gaze point B1 in accordance with the information related to the operator O who is manipulating the working machine 1.

The configuration makes it possible to set a proper region based on the information related to the operator O as the gaze point region B2. As a result, the same advantageous effects as the case of the gaze point B1 can be obtained.

Besides, the controller 40 changes the range of the gaze point region B2 in conformity with the gaze point B1 on the basis of whether or not the leading end device 25 moves to the target position T within a third predetermined time after estimating the target position T.

The configuration makes it possible to set a proper region as a gaze point region B2 on the basis of whether or not the estimation of the target position T is correct. As a result, the same advantageous effects as the case of the gaze point B1 can be obtained.

Further, the controller 40 acquires the excluded region D which is a region kept away from the target position T. The target position T is required to be outside the excluded region D.

If a region which is not supposed to be an operative target position of the operator O is set as an excluded region D, the configuration makes it possible to further improve the accuracy of the target position T.

(Modifications)

For example, a connection in a circuit in the block diagram shown in FIG. 3 may be modified. For example, the order of steps in the flowchart shown in FIG. 4 may be changed, and a part of the steps may be omitted. For example, the number of constituents of the embodiment may be changed, and a part of the constituents may be omitted. For example, a plurality of parts (constituents) which have been different from one another may constitute a single part. For example, what has been described as a single part may be constituted by a plurality of divisional parts different from one another.

For example, a part of the constituents of the target position estimating apparatus 30 (see FIG. 2, FIG. 3) may be arranged outside the working machine 1 shown in FIG. 2. For example, the controller 40 may be arranged outside the working machine 1. The operator O may remotely control the working machine 1 outside the working machine 1. In this case, the seat 17, the manipulating part 18, the manipulation detecting part 32 (see FIG. 4), and the sight detecting part 33 are arranged outside the working machine 1. In this case, the operator O performs a manipulation while watching a screen which shows an image around the working machine 1, and the sight detecting part 33 detects the sight B0 of the operator O (what section of the screen the operator O is watching).

For example, as described above, the prospective locus region A2 may coincide with the prospective locus A1 (may be a line), and the gaze point region B2 may coincide with the gaze point B1 (may have a point or line). At least one of the prospective locus region A2 and the gaze point region B2 preferably has a spatial extent.

For example, the prospective locus A1, the prospective locus region A2, the gaze point B1, and the gaze point region B2 have been exemplified to change in accordance with a certain condition. However, only one of the modifications may be made. For example, the excluded region D is not required to be set. Further, only one of the plurality of operations may be executed.

Further, the embodiment is described herein on the configuration where the upper slewing body 15 of the working machine 1 is slewed. However, the embodiment may be modified to a configuration where only the attachment 20 moves (changes the posture) whereas the upper slewing body 15 does not slew. For example, even in a case where in FIG. 1 the operator O turns the boom and the arm toward the front of the upper slewing body 15 to thereby place the leading end device 25 (leading end of the bucket) onto a ground closer to the upper slewing body 15 than the point B1, the target position T can be estimated in advance by the target position estimating apparatus 30 of the present invention.

The present invention provides an apparatus for estimating a target position supposed by an operator in a working machine which includes a machine main body having a cab allowing an operator to seat therein, an attachment mounted on the machine main body, and a leading end device provided in a leading end portion of the attachment. The target position estimating apparatus includes: a posture detecting part for detecting posture information being information related to a posture of the working machine; a manipulation detecting part for detecting manipulation information being information on the basis of which the operator manipulates the working machine; a sight detecting part for detecting sight information being information related to sight of the operator; a distance information detecting part for detecting distance information on a region in front of the working machine; and a controller for estimating a target position of the leading end device supposed by the operator when the operator manipulates the working machine to move the leading end device. The controller includes: a locus region setting section for setting, on the basis of the posture information detected by the posture detecting part and the manipulation information detected by the manipulation detecting part, a prospective locus region being a region which includes a prospective locus along which the leading end device is prospected to move and which is associated with the distance information; a gaze region setting section for setting, on the basis of the sight information detected by the sight detecting part, a gaze region being a region which includes a gaze point of the operator and is associated with the distance information; and a target position estimating section for estimating the target position of the leading end device on the basis of a region where the prospective locus region set by the locus region setting section and the gaze region set by the gaze region setting section overlap each other.

Preferably, in the configuration, the target position estimating apparatus further includes a type information acquiring part for acquiring type information being information related to a type of the leading end device, wherein the locus region setting section sets the prospective locus in accordance with the type information acquired by the type information acquiring part.

Preferably, in the configuration, the locus region setting section changes a range of the prospective locus region in conformity with the prospective locus in accordance with a moving speed of the leading end device.

Preferably, in the configuration, the posture detecting part is capable of detecting attachment posture information being information related to a posture of the attachment with respect to the machine main body, and the locus region setting section changes a range of the prospective locus region in conformity with the prospective locus in accordance with the attachment posture information.

Preferably, in the configuration, the target position estimating apparatus further includes an operator information acquiring part for acquiring operator information being information related to the operator, wherein the locus region setting section changes a range of the prospective locus region in conformity with the prospective locus in accordance with the operator information acquired by the operator information acquiring part.

Preferably, in the configuration, the controller further includes: a determining section for determining whether or not the leading end device reaches the target position within a predetermined time after the target position estimating section estimates the target position of the leading end device, and the locus region setting section changes a range of the prospective locus region in conformity with the prospective locus in accordance with the determination result of the determining section.

Preferably, in the configuration, the gaze region setting section sets a gaze region on the basis of a frequency distribution of gaze point within a predetermined time.

Preferably, in the configuration, the gaze region setting section changes a range of the gaze region in conformity with the gaze point in accordance with a moving speed of the leading end device.

Preferably, in the configuration, the target position estimating apparatus further includes: an operator information acquiring part for acquiring operator information being information related to the operator, wherein the gaze region setting section changes a range of the gaze region in conformity with the gaze point in accordance with the operator information.

Preferably, in the configuration, the controller includes: a determining section for determining whether or not the leading end device reaches the target position within a predetermined time after the target position estimating section estimates the target position of the leading end device, and the locus region setting section changes a range of the gaze region in conformity with the gaze point in accordance with the determination result of the determining section.

Preferably, in the configuration, the target position estimating apparatus further includes: an excluded region acquiring part for acquiring information related to an excluded region being a region kept away from the target position, wherein the target position estimating section estimates a target position of the leading end device on the basis of a region where the prospective locus region set by the locus region setting section and the gaze region set by the gaze region setting section overlap each other, and which excludes the excluded region.

The invention claimed is:

1. A working machine target position estimating apparatus for estimating a target position supposed by an operator operating a working machine including a machine main body having a cab which allows an operator to seat therein, an attachment mounted on the machine main body, and a leading end device provided in a leading end portion of the attachment, the working machine target position estimating apparatus comprising:

a posture detecting part for detecting posture information being information related to a posture of the working machine;

a manipulation detecting part for detecting manipulation information being information on the basis of which the operator manipulates the working machine;

a sight detecting part for detecting sight information being information related to sight of the operator;

a distance information detecting part for detecting distance information on a region in front of the working machine; and a controller for estimating a target position of the leading end device supposed by the operator when the operator manipulates the working machine to move the leading end device, wherein the controller includes:

a locus region setting section for setting, on the basis of the posture information detected by the posture detecting part and the manipulation information detected by the manipulation detecting part, a prospective locus region being a region which includes a prospective locus along which the leading end device is prospected to move and which is associated with the distance information;

a gaze region setting section for setting, on the basis of the sight information detected by the sight detecting part, a gaze region being a region which includes a gaze point of the operator and is associated with the distance information; and a target position estimating section for estimating the target position of the leading end device on the basis of a region where the prospective locus region set by the locus region setting section and the gaze region set by the gaze region setting section overlap each other.

2. The working machine target position estimating apparatus according to claim 1, further comprising:

a type information acquiring part for acquiring type information being information related to a type of the leading end device, wherein the locus region setting section sets the prospective locus in accordance with the type information acquired by the type information acquiring part.

3. The working machine target position estimating apparatus according to claim 1, wherein the locus region setting section changes a range of the prospective locus region in conformity with the prospective locus in accordance with a moving speed of the leading end device.

4. The working machine target position estimating apparatus according to claim 1, wherein the posture detecting part is capable of detecting attachment posture information being information related to a posture of the attachment with respect to the machine main body, and the locus region setting section changes a range of the prospective locus region in conformity with the prospective locus in accordance with the attachment posture information.

5. The working machine target position estimating apparatus according to claim 1, further comprising:

an operator information acquiring part for acquiring operator information being information related to the operator, wherein the locus region setting section changes a range of the prospective locus region in conformity with the prospective locus in accordance with the operator information acquired by the operator information acquiring part.

6. The working machine target position estimating apparatus according to claim 1, wherein the controller further includes a determining section for determining whether or not the leading end device reaches the target position within a predetermined time after the target position estimating section estimates the target position of the leading end device, and the locus region setting section changes a range of the prospective locus region in conformity with the prospective locus in accordance with the determination result of the determining section.

7. The working machine target position estimating apparatus according to claim 1, wherein the gaze region setting section sets a gaze region on the basis of a frequency distribution of a gaze point within a predetermined time.

8. The working machine target position estimating apparatus according to claim 1, wherein the gaze region setting section changes a range of the gaze region in conformity with the gaze point in accordance with a moving speed of the leading end device.

9. The working machine target position estimating apparatus according to claim 1, further comprising:

an operator information acquiring part for acquiring operator information being information related to the operator, wherein the gaze region setting section changes a range of the gaze region in conformity with the gaze point in accordance with the operator information.

10. The working machine target position estimating apparatus according to claim 1, wherein the controller includes a determining section for determining whether or not the leading end device reaches the target position within a predetermined time after the target position estimating section estimates the target position of the leading end device, and the locus region setting section changes a range of the gaze region in conformity with the gaze point in accordance with the determination result of the determining section.

11. The working machine target position estimating apparatus according to claim 1, further comprising:

an excluded region acquiring part for acquiring information related to an excluded region being a region kept away from the target position, wherein the target position estimating section estimates a target position of the leading end device on the basis of a region where the prospective locus region set by the locus region setting section and the gaze region set by the gaze region setting section overlap each other, and which excludes the excluded region.

* * * * *